US005801725A

United States Patent [19]

Neese et al.

[11] Patent Number: 5,801,725

[45] Date of Patent: Sep. 1, 1998

[54] SLIDABLE WIPING AND CAPPING SERVICE STATION FOR INK JET PRINTER

[75] Inventors: David A. Neese; William Golobeff, both of San Diego; Jeffrey J. Rhine, Poway; Gary Graham; Richard A. Murray, both of San Diego, all of Calif.

[73] Assignee: Encad, Inc., San Diego, Calif.

[21] Appl. No.: 433,147

[22] Filed: May 3, 1995

[51] Int. Cl.[6] ..... B41J 2/165

[52] U.S. Cl. ..... 347/32; 347/30; 347/33

[58] Field of Search ..... 347/32, 33, 30

[56] References Cited

U.S. PATENT DOCUMENTS

| | | | |
|---|---|---|---|
| 4,853,717 | 8/1989 | Harmon et al. . | |
| 5,027,134 | 6/1991 | Harmon et al. . | |
| 5,051,761 | 9/1991 | Fisher et al. . | |
| 5,103,244 | 4/1992 | Gast et al. . | |
| 5,115,250 | 5/1992 | Harmon et al. . | |
| 5,146,243 | 9/1992 | English et al. . | |
| 5,151,715 | 9/1992 | Ward et al. . | |
| 5,155,497 | 10/1992 | Martin et al. . | |
| 5,210,550 | 5/1993 | Fisher et al. . | |
| 5,257,044 | 10/1993 | Carlotta et al. . | |
| 5,300,958 | 4/1994 | Burke et al. . | |
| 5,394,178 | 2/1995 | Grange | 347/32 |
| 5,396,277 | 3/1995 | Gast et al. . | |
| 5,440,331 | 8/1995 | Grange | 347/32 |
| 5,585,826 | 12/1996 | Schroeder et al. | 347/29 |

FOREIGN PATENT DOCUMENTS

| | | |
|---|---|---|
| 0 552 030 A1 | 7/1993 | European Pat. Off. . |
| 0 622 199 A2 | 2/1994 | European Pat. Off. . |
| 0 589 582 A2 | 3/1994 | European Pat. Off. . |

*Primary Examiner*—Benjamin R. Fuller
*Assistant Examiner*—Thien Tran
*Attorney, Agent, or Firm*—Knobbe, Martens, Olson, & Bear, LLP

[57] ABSTRACT

A service station for an ink jet printer is provided with a base station and a sliding sled having both wipers and caps mounted thereon. Power for sled motion during wiping and capping is provided by the movement of the print carriage of the ink jet printer. Sled motion is guided by pins on the sled which engage slots on the base station. A plank holds the sled in a temporarily stationary position during wiping.

14 Claims, 4 Drawing Sheets

SLIDABLE WIPING AND CAPPING SERVICE STATION FOR INK JET PRINTER

BACKGROUND OF THE INVENTION

1. Field of the Invention

The invention relates to a device which is used to protect and to maintain the operability of inkjet print heads. In particular, the invention relates to an improved service station which is completely mechanically operated based on the position of the print carriage and is easy to install in the printer.

2. Description of the Related Art

In order to maintain the operability of an inkjet printer, it is necessary to periodically service the print heads. One important service which is performed is the cleaning of the print heads. The cleaning of the print heads reduces the buildup of ink on the print head which will dry and clog the jet openings on the print head. In addition, the cleaning of the print head reduces the dust and dirt which can accumulate on the print head and cause clogging. In a typical color inkjet printer, up to four colors of ink in up to four different ink cartridges are used. Typically, a single wiper blade is used to clean all of the print heads. This is not desirable as ink from one of the print heads can be transferred to other print heads by the wiper blade and will contaminate the other print heads.

Another service performed by the service station is to cap the print heads when they are not in use to protect the print head from damage and to prevent the ink from drying out and clogging the nozzles. The caps are used to provide a high humidity environment around the jet openings and should maintain an equalized pressure between the sealed cap environment and ambient pressure. A change in pressure in the sealed environment can cause priming of the nozzles, if the relative pressure decreases, or can cause the nozzles to become deprimed if the relative pressure is increased.

In another service step, ink is discharged from the nozzles into the service station to keep the less frequently used nozzles from clogging. However, if ink is discharged each time the print head is serviced, ink can buildup in the service station since it has no overflow locations. Therefore, the service station must be periodically removed for cleaning. Due to the complex mechanical assemblies and the plurality of electrical connections to the service station, the removal of the service station can be a major undertaking.

Many prior at service stations have included complex mechanical assemblies in order to meet all of servicing requirements of the print head. For example, U.S. Pat. No. 5,155,497 issued to Hewlett-Packard describes a service station which includes a complex rotatable service station which alternates between two different positions for servicing either black or color inkjet cartridges. The rotating mechanism helps prevent contamination from occurring between the color and black print heads. Even though a distinction is made between the black and color print heads, the same wiper is used for all of the nozzles of the color print head therefore enabling contamination to occur amongst the nozzles of the color print head.

In addition, U.S. Pat. No. 5,394,178 also issued to Hewlett Packard includes a complex pivoting cam member to enable different wipers to clean different print heads in order to prevent contamination of the print heads via the wipers. The pivoting cam member prevents a first wiper from contacting a first print head while a second wiper cleans the first print head. When one end of the cam contacts the first print head, the cam pivots and enables the first wiper to contact and clean the second print head. The carriage is stopped before the second wiper contacts the second print head. This service station requires the use of a motor to control the positioning of the service station with the print carriage to ensure proper cleaning.

Further, the NovaJet III printer which is made by ENCAD, Inc. the assignee of the present application currently includes a service station which utilizes a solenoid to control the application of a single wiper blade.

All of these prior art service stations are complex mechanical assemblies having several disadvantages including (1) creating assembly problems, (2) increasing the modes of failure for the printer (3) creating service station maintenance problems and (4) increasing the overall cost of the printer.

SUMMARY OF THE INVENTION

The service station of the present invention provides a solution to all of the requirements of the prior art inkjet services stations while reducing the complexity of the service station, thereby reducing the manufacturing and assembly costs of the inkjet printer and improving the reliability of the printer. The service station is a self contained operating unit including a base unit and a service station sled and requires no outside forces such as a motor or solenoid to align the service station sled including the caps and wipers with the print carriage. The service sled moves amongst three operational positions (1) a deactivated position, (2) a wiping position and (3) a capping position.

A significant feature of the preferred embodiment of the invention is that the three operating positions of the service station sled are achieved relying only the mechanical force of the print carriage against the sled.

Further, the service station of this invention provides for its easy insertion and removal from the printer to enable routine maintenance of the service station. Since there are no electrical or motor connections required between the service station and the printer housing, the installation and removal of the service station is greatly simplified.

DETAILED DESCRIPTION OF THE PREFERRED EMBODIMENT

Figure 1:
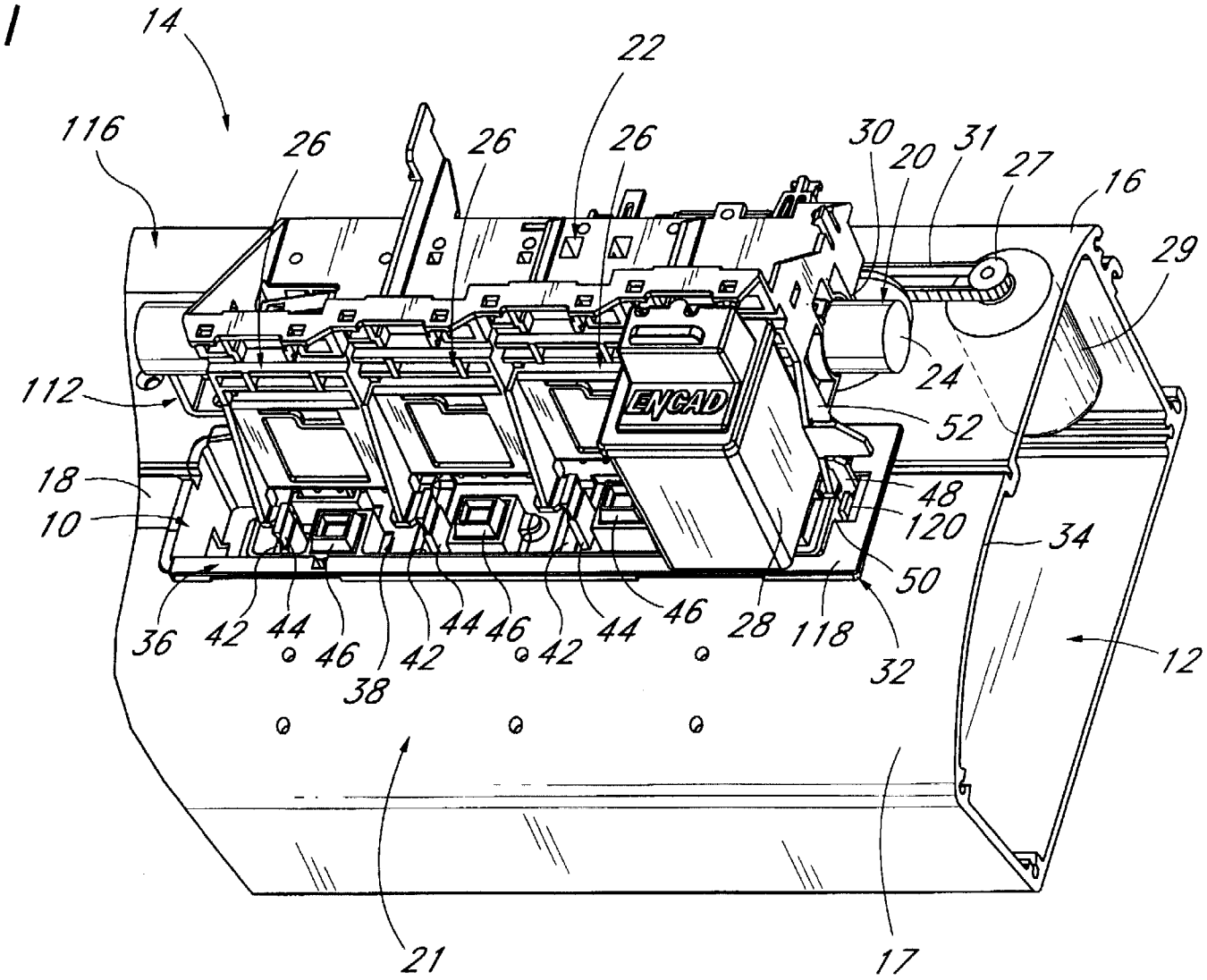
FIG. 1 is a perspective view of the service station mounted within an inkjet printer.

As illustrated in FIG. 1, a service station 10 is contained in the housing 12 of an ink-jet printer 14. The housing 12 is supported by a stand (not shown) and encloses various electrical and mechanical components related to the operation of the printer/plotter device, but not directly pertinent to the present invention. As an exemplar of a printer device, the assignee of the present application sells a thermal ink jet printer device under the trade name of NovaJet III. An operations manual of the NovaJet III printer entitled "NovaJet III User's Guide" (ENCAD Part No. 202409) is hereby incorporated by reference. In order to minimize the complexity of the printer apparatus and maintain a low manufacturing cost, the printer of the present invention is advantageously very similar to the NovaJet III, with the exception of the service station 10 of the present invention which is described in more detail below. In one embodiment, the printer is a printer as described in a co-pending application entitled INKJET PRINTER WITH MULTIPLE COLOR PRINTHEADS which is assigned to ENCAD, Inc., the assignee of the present application, and which is hereby incorporated by reference.

A portion of a top side 17 of the housing 12 forms a platen 18 upon which the printing/plotting is performed by select deposition of ink droplets on to the print media (not shown). In one embodiment, a continuous roll of print media is mounted on the rear side 16 of the housing 12. The print media is guided from the rear side 16 of the housing 10 under a support structure 20 and across the platen 18 by a plurality of drive rollers (not shown) which are spaced along the platen 18. In another embodiment, individual sheets of print media are fed into the front side 21 of the housing 12 as needed. The print media is guided from the front side 21 of the housing 10 under the support structure 20 and across the platen 18 by a plurality of drive rollers (not shown) which are spaced along the platen 18.

The support structure 20 is mounted to the top side 17 of the housing 12 with sufficient clearance between the platen 18 and the support structure 20 along a central portion of the platen 18 to enable a sheet of paper which is to be printed on to pass between the platen 18 and the support structure 20. The support structure 20 including at least a guide rod 24 supports a print carriage 22 above the platen 18 and parallel to the longitudinal axis of the housing 12.

The print carriage 22 supports a plurality of printer cartridge holders also referred to as cartridge receiving channels 26 each with a respective printer cartridge 28, removably mounted therein. In a preferred embodiment of a multiple color printer, the print carriage 22 includes at least four printer cartridge holders 26 and at least four respective printer cartridges 28. For simplicity, FIG. 1 illustrates the print carriage 22 with only one print cartridge 28 shown. The print carriage 22 includes two split sleeves 30 which partially surround and slidably engage the guide rod 24 to support the print carriage 22 for linear movement of the carriage 22 along the guide rod 24 as shown by the bi-directional arrow in FIG. 1, along which the print carriage 22 moves. The print carriage 22 traverses a length of the platen 18 upon which printing can be accomplished, this length of the platen 18 is referred to as the printing path of the carriage 22. A motor 29, pulley 27 and drive belt mechanism 31 are used to drive the print carriage 22 along the guide rod 24. In a preferred embodiment, the motor 29 is a 19.1 volt DC brush servomotor manufactured by Buchler Products, Inc. located in Raleigh, N.C. The motor 29 is advantageously the same size motor 29 which is used to drive a typical print carriage 22. Significantly, the sled 38 is made from a light weight plastic polycarbonate material reinforced with 10% glass and 10% carbon fiber using a traditional injection molding process so the force of the typical print carriage motor 29 is sufficient to move the sled 38. The operation of the print carriage 22 is controlled by the main printer electronics or print engine, as known to those in the inkjet printer art and not shown in FIG. 1, which is contained in the printer enclosure (not shown).

The service station 10 is mounted within a rectangular receiving cavity 32 in the platen 18. The receiving cavity 32 is located at a far end 34 of the printer housing 12 and is positioned in-line with the printing path which is traversed by the print carriage 22 along the platen 18. Preferably, the receiving cavity 32 is positioned at the far end 34 of the platen 18 such that it is beyond the width of the printing path of the carriage 22. In order to engage the service station 10, the print carriage 22 simply continues to travel along the guide ride 24 to a location on the far end 34 of the platen 18 beyond the printing path.

The service station 10 is a self contained operating unit and includes a base unit 36 and a service sled 38. The base unit 36 is fixably mounted in the platen 18 while the service sled 38 moves within the base unit 36. The service sled 38 moves amongst three operational positions (1) a deactivated position, (2) a wiping position and (3) a capping position. FIG. 1 illustrates the service sled 38 in the capping position with only one of the four inkjet cartridges 28 being shown. The service sled 38 contains for each print head 28 a spittoon 42, a wiper 44, and a cap 46. As known to those in the inkjet art, a spittoon 42 is used to collect the ink that is periodically fired over the service station 10 in order to clean out the nozzles on the jet plate; the wiper 44 is used to clean off any excess ink and dirt or dust which may collect on the jet plate, and the cap 46 is used to provide a high humidity environment around the jet openings on the jet plate when the inkjet cartridge is not in use. The print heads 28 are staggered on the print carriage 22, therefore the wipers 44 and caps 46 are respectively staggered on the service sled 38 to align with their respective print head 28. Advantageously, the wiper 44 and cap 46 for each print head 28 are staggered and positioned in the sled 38 such that each of the individual print heads 28 will not come into contact with the wipers 44 and caps 46 for the other print heads, thereby preventing contamination caused by mixing inks amongst the print heads 28.

The sled 38 also includes a stop 48 at a first end 76 of the sled 38 for engagement with a first end 52 of the carriage 22. As the carriage 22 approaches the serve station 10 on the platen 18, a first end 52 of the carriage 22 engages the stop 48. As the carriage 22 continues to move, the engagement of the stop 48 and the first end 52 of the carriage 22 causes the carriage 22 to pull the service sled 38 into the wiping and/or capping position depending on the distance that the carriage 22 moves. Significantly, the stop 48 enables the motor and drive belt mechanism which powers the print carriage 22 to be utilized to provide the energy for moving the service sled 38 into its various positions. Thus, in contrast to the prior art, an additional motor or other electrically powered device does not have to be added to the printer to provide the power to operate the service station.

Figure 2:
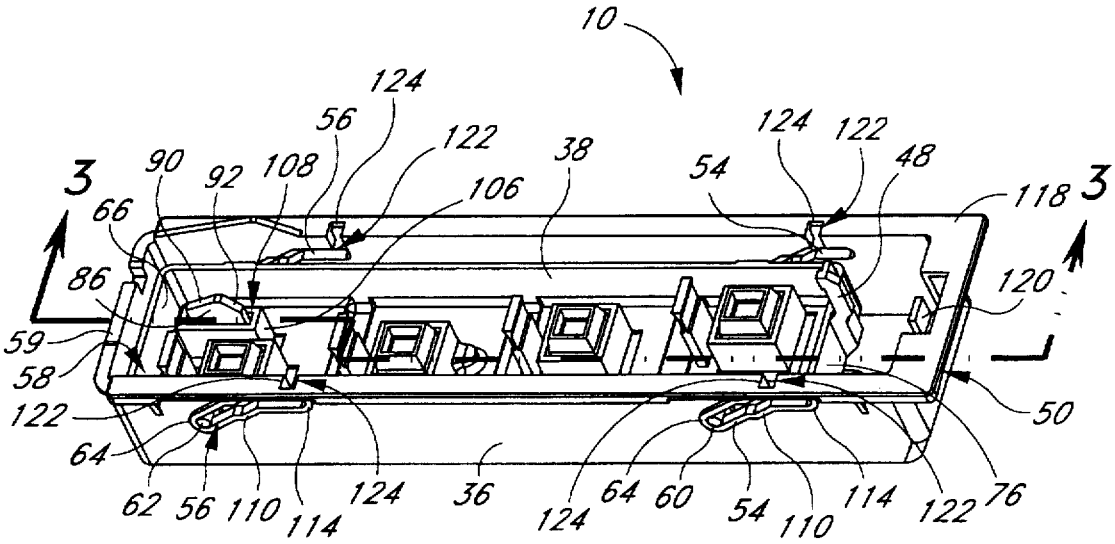
FIG. 2 is a perspective view of the service station in the deactivated position.
Figure 3:
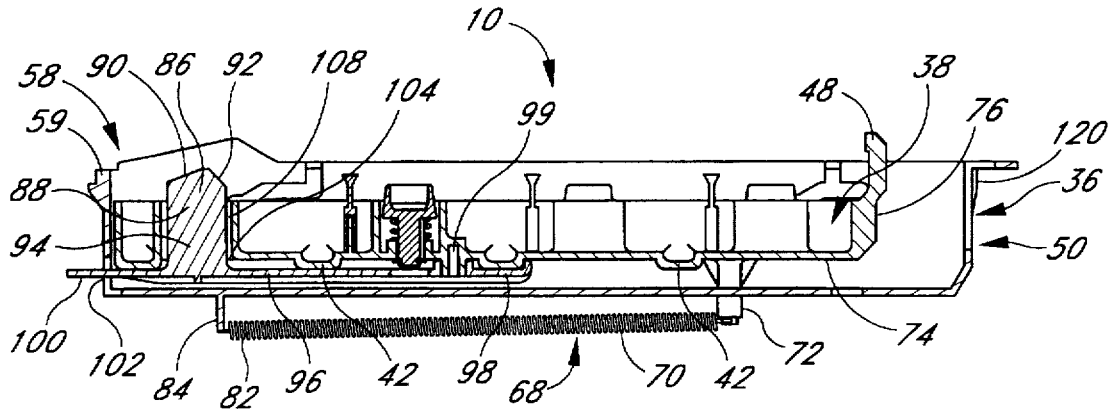
FIG. 3 is a cross-sectional view of the service station through the line 3—3 in FIG. 2.
Figure 4:
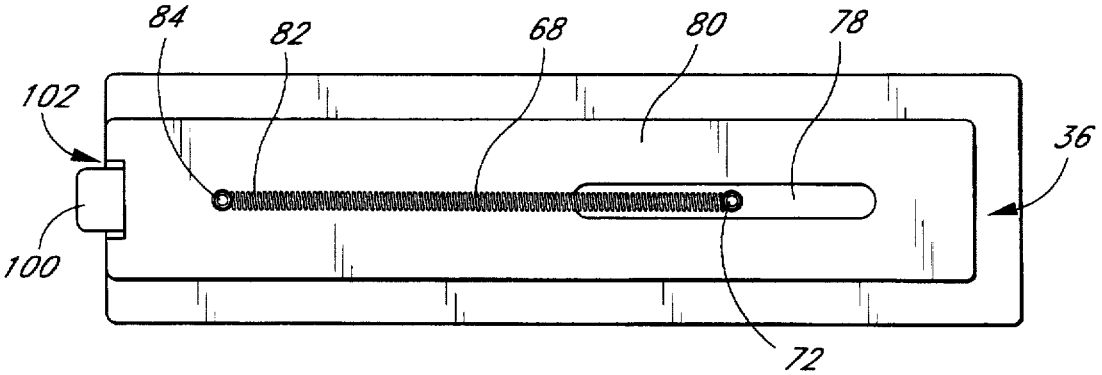
FIG. 4 is a bottom plan view of the service station of FIG. 2.

Referring to FIGS. 2–4, the service station 10 is illustrated in the deactivated position. The base unit 36 has first and second pairs of inclined slots 54,56 on opposing sides of the base unit 36. The first pair of inclined slots 54 is positioned at a first end 50 of the base unit 36 and the second pair of inclined slots 56 is positioned at a second end 58 of the base unit 36. The sled 38 includes first and second pairs 60, 62 of mating pegs on opposite sides of the sled 38. Each of the mating pegs 60, 62 is slidably engaged with its respective inclined slot 54,56. The motion of the pegs 60,62 in the slots 54,56 controls the motion of the sled 38 within the base unit 36. In the deactivated position, the pegs 60,62 are located at a bottom end 64 of the inclined slots 54,56. In the deactivated position, a second end 66 of the service station sled 38 abuts the inside surface of a second wall 59 of the base unit 36.

The sled 38 is biased to return to the deactivated position by a spring 68. A first end 70 of the spring 68 is attached to a first pin 72 which is mounted to the bottom 74 of the sled 36 proximal to a first end 76 of the sled 36. The first pin 72 extends through a slot 78 in a bottom 80 of the base unit 36, so the spring is attached below the base unit 36. A second end 82 of the spring 68 is attached to a second pin 84 which is mounted to the bottom 80 of the base unit 36. The spring tension and spring length are desirable chosen such that the spring 68 is under low tension when the sled 38 is in the deactivated position and is extended when the sled 38 is in the wiping and capped positions. Thus, when the sled 38 is in the wiping and capped positions, the force of the extended spring 68 biases the sled 38 to return to the deactivated position.

In the deactivated position, as the carriage 22 moves across the service station, the carriage 22 does not contact a beveled rectangular button 86 which extends from the second end 66 of the sled 38. A top portion 88 of the beveled button 86 has first and second sloped sides 90,92 each having a different slope. The first side 90 has a shallow slope and the second side 92 has a steeper slope. A bottom end 94 of the beveled button 86 is connected to a plastic plank 96. In a preferred embodiment, the beveled button 86 and the plank 96 are a unitary molded part. A first end 98 of the plank 96 is springboard mounted about a screw 99 to a bottom end 74 of the sled 38 proximal to the middle of the sled 38. The base unit 36 includes a rectangular cutout 102 in the second wall 59 and in a portion of the bottom 80 of the base unit 36. When the sled 38 is in the deactivated position, a second end 100 of the plank 96 extends through the cutout 102 and slightly beyond the second wall 59 of the base unit 36. The beveled button 86 extends up from the plank 96 through a rectangular opening 104 in the bottom end 74 of the sled 38. The opening 104 in the sled 38 is surrounded by four walls 106 forming a rectangular passageway 108 in which the beveled rectangular button 86 resides.

Referring also to FIG. 1, when the service station 10 is in the deactivated position, the print carriage 22 moves across the guide rod 24 and aligns the print heads 28 with the spittoons 42. The print heads will eject ink from the nozzles on the jet plate to clear out any ink which may be clogging the print head. The amount of ink that is spit can vary with the operation of the printer. For example, when the printer is turned on, approximately 200 drops of ink are ejected from each of the nozzles on the print heads 28; when a cartridge 28 is replaced, approximately 150 drops of ink are ejected from each nozzle on the changed cartridge 28 into the spittoons 42 before printing resumes; and after printing occurs continually for fifty seconds, approximately 8 drops of ink are ejected from each of the nozzles on the print heads 28 into the spittoons 42. The ejection of ink can be combined with the wiping and capping operations. For example, if during normal operation of the printer, the printing is halted for more than four minutes, the service station is moved to the capping position. When printing resumes, the print heads 28 are first wiped while the service station is in the wiping position. Next, the service station 10 is moved to the deactivated position and ink is ejected from the nozzles on the print heads 28 into the spittoons 42 before printing begins.

When the service station 10 is in the deactivated position, the carriage 22 traverses the platen 18 without contacting any element of the service station 10 until the first end 52 of the carriage 22 engages the stop 48. As the carriage 22 continues to move, the engagement of the stop 48 and the first end 52 of the carriage 22 causes the carriage 22 to push the service sled 38 out of the deactivated position and initially into the wiping position. The motor 29 driving the carriage 22 is selected such that the force of the carriage 22 on the sled 38 is sufficient to pull the weight of the sled 38 while overcoming the force of the spring 68 which attempts to return the sled 38 to the deactivated position. As the carriage 22 pulls the sled 38, the pegs 60,62 respectively move within the inclined slots 54,56 causing the lateral fore of the carriage 22 on the stop 48 to be translated into both vertical and lateral motion of the sled 38 within the base unit 36.

Figure 5:
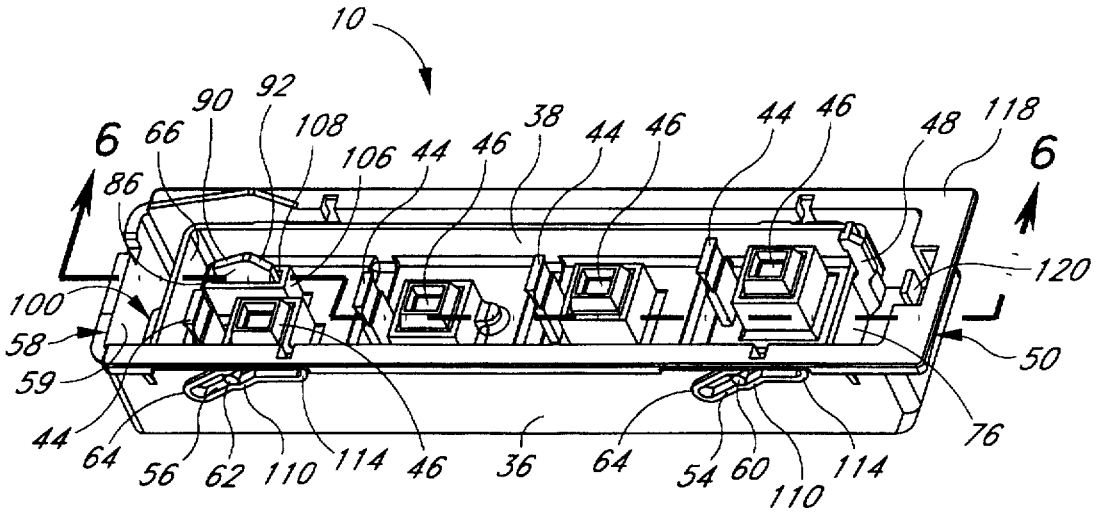
FIG. 5 is a perspective view of the service station in the wiping position.
Figure 6:
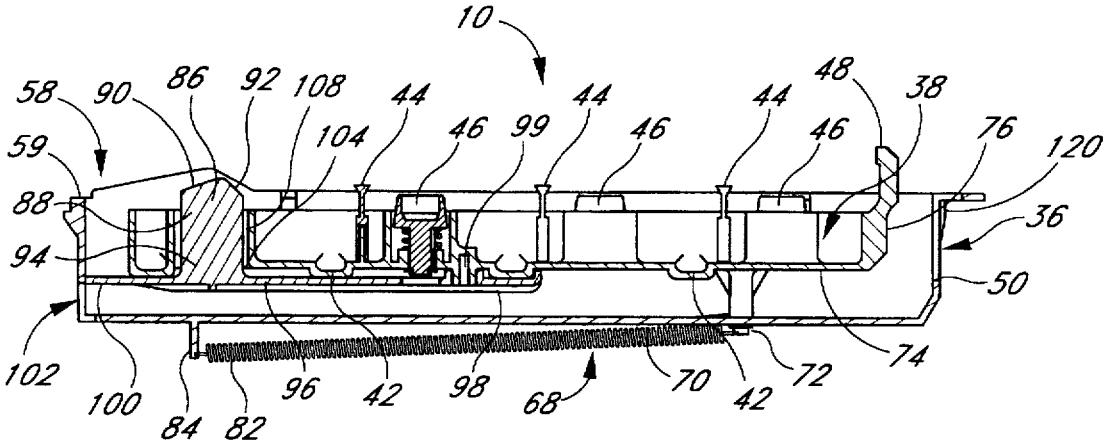
FIG. 6 is a cross-sectional view of the service station through the line 6—6 in FIG. 5.

The carriage 22 moves laterally towards the far end 34 of the platen 18 until the pegs 60,62 in the slots 54,56 have moved just past an intermediate plateau 110 of the slot 54,56. As the sled 38 is pulled by the carriage 22, the second end 100 of the plank 96 is pulled through the cutout 102, and due to the vertical movement of the sled 38 rises to a location just above the cutout 102. As the sled 38 settles in the wiping position, the second end 100 of the plank 96 abuts the inside surface of the second wall 59 of the base unit 36. FIGS. 5–6 illustrate the service station 10 in the wiping position. The force of the plank 100 against the inside surface of the second wall 59 is enough to temporarily mechanically restrain the sled in place by overcoming the force of the spring 68 against the sled 38 which is trying to return the sled 38 to the deactivated position. The sled 38 remains in the wiping position due to the force of the plank 100 against the second wall 59. While the sled 38 is in the wiping position, the pegs 60,62 of the sled 38 rest in the intermediate plateau 110 in the slot 54,56. The wiping position of the sled 38 is determined such that the jet plate of the inkjet cartridges will not come into contact with the caps 46, but will come into contact with the wiper blades 44.

In order to perform the wiping step, the carriage 22 begins to move away from the far end 34 of the platen 18, thus disengaging the carriage 22 from the stop 40. The sled 38 will be pulled by the force of the extended spring 68 away from the far end 34 of the platen 18 and will come to rest in the wiping position. Once the sled 38 is in the wiping position, the printer carriage 22 continues to move away from the far end 34 of the platen 18 while the service station sled 38 remains stationary. As the print carriage 22 moves, the wiper blades 44 come into contact with their respective jet plates and wipe the excess ink from the jet plate nozzles. In a preferred embodiment, the print carriage 22 moves approximately 0.75 inches in its wipe cycle. In order to maintain the sled 38 in the wiping position, the force of the plank 96 against the second wall 59 of the base unit 36 is sufficient to not only overcome the spring force 68 on the sled 38, and gravity, but must also overcome the frictional force generated by dragging the wiper blades 46 across their respective jet plates.

When the carriage 22 has completed the wipe cycle, the carriage 22 continues to move away from the far side 34 of the platen 18. As the carriage 22 continues to move away from the far side 34 of the platen 18, a rib (not shown) on the underside of the print carriage 22 proximal to a second end 112 of the carriage 22 comes into contact with the steep sloped side 92 of the beveled rectangular button 86. As the rib which is proximal to the second end 112 of the carriage 22 pushes against the button 86, the lateral movement of the carriage 22 against the steep sloped portion 92 of the beveled button 86 is translated into a downward component of force on to the plank 96. As the plank 96 is pushed downward, the second end 100 of the plank 96 is released from contact with the second wall 59 of the base unit 36. The downward force on the plank 96 enables the second end 100 of the plank 96 to slip through the cutout 102 in the second wall 59 of the base unit 36. As the button 86 is pushed downward, the button 86 is released from contact with the print carriage 22. The printer carriage 22 continues to move without moving the service station sled 38. Once the plank 96 is released from contact with the second wall 59, the force of the extended spring 68 pulls the sled 38 back towards the second wall 59. The path of the sled's motion is controlled by the movement of the pegs 60,62 in the inclined slots 54,56. As the spring 68 pulls on the sled 38, the sled 38 is pulled backward and downward into the deactivated position.

From the deactivated position, the sled 38 may also be moved into the capping position. As the print carriage 22 moves toward the far end 34 of the platen 18, the first end 52 of the print carriage 22 once again engages with the stop 48. As the carriage 22 continues to move, the engagement of the stop 48 and the first end 52 of the carriage 22 causes the carriage 22 to pull the service sled 38 out of the deactivated position. As indicated above, the force of the carriage 22 on the sled 38 must be sufficient to pull the weight of the sled 38 while overcoming the force of the spring 68 and gravity which both attempt to return the sled 38 to the deactivated position. As the carriage 22 pulls the sled 38, the pegs 60,62 move within the inclined slots 54,56 causing the lateral movement of the carriage 22 against the stop to be translated into both vertical and lateral motion of the sled 38 within the base unit 36. The pegs 60,62 move along the first incline portion 64 of the slot 55,56 and continue to travel through the intermediate plateau 110 and up a second incline position 114 as the carriage continues to move laterally toward the far end 34 of the platen 18. As the carriage 22 continues to move, the sled 38 is pulled through the wiping position and into the capping position.

Figure 7:
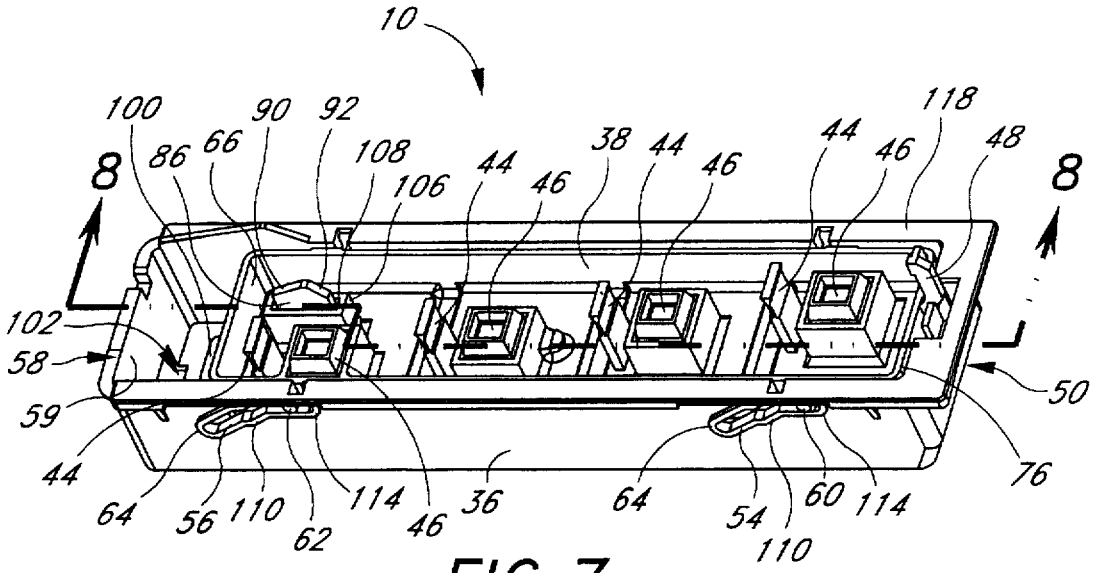
FIG. 7 is a perspective view of the service station in the capped position.
Figure 8:
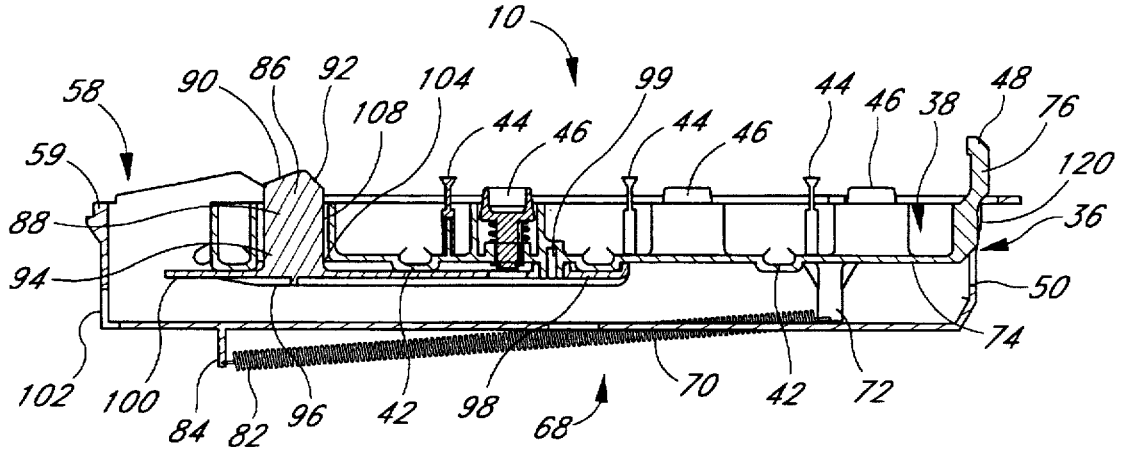
FIG. 8 is a cross-sectional view of the service station through the line 8—8 in FIG. 7.

FIGS. 1 and 7–8 illustrate the service station 10 in the capping position. The capping position is used between print jobs to prevent the print heads 28 from drying out. The service station 10 is held in the capping position by the force of the first end 52 of the print carriage 22 against the stop 48. Without the force of the print carriage 22 against the stop 48, the spring 68 would force the sled 38 to return to the wiping position. In the capping position, a spring loaded elastomeric cap 46 is brought into contact with its respective print head 28. Preferably, the spring loaded caps 48 are made of low durometer EPDM based material. In a preferred embodiment, the caps are approximately 45 durometer EPDM based material. The elastomeric caps 46 are spring loaded to ensure that a proper seal is formed around the jet plate of the print head 28 despite possible variances in the vertical position of the sled 38. In the capping position, the wiper blade 44 is tucked inside a recess (not shown) in the print carriage 22 to enable the cap 46 to form a proper seal around its respective jet plate (not shown).

When printing is going to resume, the print carriage 22 moves away from the far end 34 of the platen 18. As the print carriage 72 moves away from the far end 34, the force of the print carriage 22 against the stop 48 is removed such that the force of the extended spring 68 begins to pull the sled 38 back towards the second wall 54 of the base unit 36. The pegs 60,62 of the sled 38 travel within their respective slots 54,56 and cause the sled to move in a downward as well as a lateral direction. Eventually, the second end 100 of the plank 96 of the sled 38 comes into contact with the second wall 59 of base unit 36. When this occurs, the pegs 60,62 of the sled 38 have reached the plateau 110 in the slots 54,56 and the sled 38 halts in the wiping position. As the print carriage 22 continues to move, the sled 38 remains in the wiping position. As described above, the print carriage 22 traverses through the wiping path cleaning off the excess ink and continues to travel away from the far end 34 of the platen 18. As the print carriage 22 continues to move while the sled 38 is stationary, the second end 112 of the print carriage 22 contacts the steeply sloped side 92 of the beveled button 86 as also described above and releases the service sled 38 from the wiping position. The sled 38 returns to the deactivated position and the print carriage 22 is ready for printing.

Advantageously, if the service station 10 accidentally is moved into or is stuck in the wiping position, the service station 10 includes a self-correcting feature. For example, if the service station 10 is in the wiping position when it is supposed to be in the deactivated position, the service station's position can be corrected by running the print carriage 22 one complete cycle back and forth across the platen 18.

Referring to FIGS. 1, 5, and 6, as the print carriage 22 moves across the platen 18 approaching the far side 34 of the platen 18, the first end 52 of the print carriage 22 will come into contact with the shallow sloped end 90 of the beveled button 86 due to the raised height of the sled 38 in the wiping position. As the first end 52 of the carriage pushes against the shallow sloped end 90 of the beveled button 86, the lateral movement of the carriage 22 against the sloped portion 90 of the beveled button 86 is translated into a downward component of force. As the button 86 is pushed downward it is released from contact with the print carriage 22 and the print carriage 22 continues to move to the far side 34 of the platen 18 without moving the service station sled 38. Further, the downward force component on the button 86 pushes the pivotable plank 96 downward.

As the plank 96 is pushed downward, it is released from contact with the second wall 59 of the base unit 36 and slips into the cutout 102 in the second wall 59. Once the plank 96 is released from contact with the second wall 59, the force of the extended spring 68 pulls the sled 38. The pegs 60,62 on the sled 38 must move within the inclined slots 54,56, which forces the sled 38 downward and toward the second end 58 of the base unit 36.

As the spring 68 pulls on the sled 38, the sled 38 is returned to the deactivated position, the positioning of the service station 10 is corrected, and the printer 14 is ready to resume normal operation. If desired, the print carriage 22 may continue to move towards the far side 34 of the platen 18 into either the wiping or capping position. As described above, the first end of the print carriage 22 engages the stop 48 on the first end 76 of the sled 38 and will pull the sled along with the print carriage 22 into the wiping or capping position which ever is desired.

Another feature of the service station 10 of the present invention is the ease of installation and removal of the service station 10. Since there are no electrical or motor connections required between the service station 10 and the printer housing 12, the installation and removal of the service station 10 is greatly simplified.

Referring back to FIG. 1, the service station 10 is installed in the printer 14 as follows. First, the printer carriage 22 is moved to the opposite side 116 of the platen 18 in order to enable the service station 10 to be accessed. The second end 58 of the base unit 36 of the service station 10 is first inserted into the rectangular receiving cavity 32 in the platen 18, with a flanged edge 118 of the base unit 36 remaining above the platen surface 18. The base unit 36 is rotatably lowered in the receiving cavity 32, with the flange 118 around the base unit 36 keeping the base unit 36 from falling through the rectangular receiving cavity 32. The base unit 36 is continually lowered into the rectangular receiving cavity 32 until the first end 50 of the base unit 36 is just above the rectangular receiving cavity 32. The first end 50 of the base unit 36 is pushed into the receiving cavity 32, while a pivotable tab 120 is retracted such that the first end 50 of the base unit 36 can fit within the rectangular receiving cavity 32. The pivotable tab 120 is released and abuts the rectangular receiving cavity 32 to hold the base unit 36 in place within the rectangular receiving cavity 32.

To remove the service station 10, the pivotable tab 120 on the first end 50 of the base unit 36 is retracted from contact with the rectangular receiving cavity 32 such that the first end 50 of the base unit 36 can be pulled through the rectangular receiving cavity 32. After the first end 50 of the base unit 36 is removed from the rectangular receiving cavity 32, the remainder of the base unit 36 is rotatably lifted upward and removed from the receiving cavity 32.

The ease of the insertion and removal of the service station 10 enables routine maintenance of the service station 10 to be performed. Once the service station 10 has been removed from the platen 18 as described above, the service sled 38 is removed from the base unit 36 for cleaning. The sled 38 is manually moved through the wiping position and into the capping position such that the pegs 60,62 are located in the second incline portion 114 of the slots 54,56. As shown in FIG. 2, the second inclined portion 114 of the slots 54,56 includes access slots 122. The first end 76 of the sled 38 is position such that the first pair of pegs 60 are aligned with the access slots 122 in the first pair of slots 54. The sled 38 is pulled upwards, and the pegs 60 pass through the access slot 122 and an opening 124 in the flange 118, thus lifting the first end 76 of the sled 38 out of the base unit 36. Once the first end 76 of the sled 38 is pulled out of the base unit 36, the first end 70 of the spring 68 is removed from the first pin 72, thus completely disconnecting the first end 76 of the sled 38 from the base unit 36.

Next, the sled 38 is pulled farther along such that the second pair of pegs 62 are aligned with the access slot 122 in the second pair of slots 56. The sled 38 is pulled upward, and the second pair of pegs 62 pass through the access slot 122 and through an opening 124 in the flange 118, thus removing the remainder of the sled 38 from the base unit 36. Once the sled 38 has been disconnected, it can be run under water to remove the excess ink which was deposited into the spittoons 42 and to clear away any dirt, dust, and ink that was removed by the wiper blades 44. Once the sled 38 is clean, it is returned to the base unit 36 following the instructions for removal in reverse. Next, the service station 10, including the base unit 36 and sled 38, can be reinstalled into the rectangular receiving cavity 32 in the platen 18, as described above. Once the service station 10 has been reinstalled in the printer 14, normal operation can resume.

Significantly, the service station is a self contained operating unit and requires no outside forces such as a motor or solenoid to align the service station sled with the print carriage and/or the wiper(s) and the print heads. The service sled moves amongst three operational positions: (1) a deactivated position, (2) a wiping position and (3) a capping position by relying on the contact between the print carriage and the service station. By utilizing the energy of the drive belt and motor which drives the print carriage to align the service station with the print carriage rather than adding an additional motor, the complexity of the printer is reduced, thereby lowering the cost of the printer. In addition, the simplistic design of the service station and its self correcting positioning feature helps reduce the number of failure modes of the printer.

Finally, as indicated above, the installation and the removal of the service station is quite simple. This reduces the number of assembly steps and assembly costs required to build the printer. Further, the ease of removal and installation enables the service station to be easily maintained to ensure proper operation for the lifetime of the printer.

The present invention may be embodied in other specific forms without departing from its spirit or essential characteristics. The described embodiments are to be considered in all respects only as illustrative and not restrictive. The scope of the invention is, therefore, indicated by the appended claims rather than the foregoing description. All changes which come within the meaning and range of equivalency of the claims are to be embraced within their scope.

What is claimed is:

1. A service station for an ink jet printer including a movable carriage supporting at least one ink jet cartridge having an ink jet plate located in juxtaposition with a printing path of said printer and wherein mechanical force for providing functions of the service station is provided by the movable carriage, said service station comprising:

a base unit mounted substantially in-line with said printing path of said printer and;

a sled having a plank, wherein said sled is retained in slidable contact with said base unit, wherein said sled has a wiper blade and a sealing cap attached thereto such that sled motion causes motion of both said wiper blade and said sealing cap, and wherein said sled has three operational positions: (1) a deactivated position, (2) a wiping position in which the sled is temporarily mechanically retained in place by said plank of said sled which temporarily engages said base unit to retain said sled in place when said sled is in said wiping position and wherein said ink jet plate of said at least on ink jet cartridge is wiped by said wiper blade to remove excess ink therefrom, and (3) a capping position in which said ink jet plate is sealed by said sealing cap, said sled being moved into each of said operational positions substantially entirely by said mechanical force supplied by said moveable carriage.

2. A service station for an inkjet printer, wherein said inkjet printer includes a print carriage moveable across a platen for printing, said service station comprising:

a base unit, and a sled having a plank which is slidable within said base unit into a wiping position and a capping position, wherein said sled is configured so that the print carriage is engagable with said sled for moving said sled into said capping position and said wiping position, and wherein said sled is substantially prevented from sliding while in the wiping position by said plank of said sled which engages with said base unit when said sled is in said wiping position.

3. The service station of claim 2 wherein said sled includes a first stop for engagement with said print carriage for movement of said sled into said wiping and said capping position.

4. The service station of claim 2 wherein said sled includes a beveled button for engagement with said print carriage for returning said sled to a deactivated position.

5. A method of performing a service to an inkjet printer carriage utilizing an improved service station comprising a base unit, a sled moveable within said base unit into a plurality of operational positions, said print carriage including a plurality of inkjet cartridges an said print carriage being engageable with said sled for moving said sled into said plurality of operational positions, wherein said inkjet printer carriage is moveable across a platen for printing, said method comprising the steps of:

moving said print carriage across said platen in forward direction until said print carriage comes into contact with one end of said sled;

positioning said sled into a first wiping position by sliding said sled along at least one inclined surface, wherein said sled is positioned such that a plurality of wiper blades are aligned for contact with a plurality of inkjet cartridges by lateral movement of said print carriage against one end of said sled in said forward direction;

maintaining said sled in said wiping position as said printer carriage is moved in a backward direction across a wiping path and each of said inkjet cartridges are wiped with a respective wiper blade;

moving said print carriage in said backward direction beyond the wiping path until a second end of said print carriage comes into contact with a button on said sled; and positioning said sled into a deactivated position, due to a downward force by said print carriage against said button.

6. A method of performing a service to an inkjet printer carriage utilizing an improved service station comprising a base unit, and a sled moveable within said base unit into a plurality of operational positions, said print cartridge including a plurality of inkjet cartridges and said print carriage being engagable with said sled for moving said sled into said plurality of operational positions, wherein said inkjet printer cartridge is moveable across a platen for printing, said method comprising the steps of:

moving said print carriage across said platen in forward direction until said print carriage comes into contact with one end of said sled;

positioning said sled in a capping position, wherein said sled is positioned such that each of a plurality of caps are aligned for contact with a respective jet plate on said inkjet cartridges, by lateral movement of said print carriage against one end of said sled in said forward direction;

maintaining said sled in said capping position by print carriage force against said one end of said sled in said forward direction;

moving said print carriage in a direction opposite to said forward direction;

engaging a second end of said print carriage with a button on said sled; and positioning said sled into a deactivated position due to a downward component of force produced by said print carriage against said button.

7. A method of performing a service to an inkjet printer carriage as defined in claim 6 additionally comprising the steps of:

moving said print carriage across said platen in said backward direction until one end of said sled comes into contact with one end of said base unit causing said sled to rest in a wiping position;

maintaining said sled in said wiping position as said printer carriage is moved in said backward direction across a wiping path and each of said inkjet cartridges are wiped with a respective wiper blade;

moving said print carriage in said backward direction beyond the wiping path.

8. The service station of claim 1, additionally comprising a button coupled to said plank for releasing said plank from engagement with said base unit.

9. A service station for an ink jet printer comprising:

a base unit including inclined surfaces, said inclined surfaces having a lower portion and an upper portion;

a sled having at least one wiper and at least one cap mounted thereon, said sled being slidably engaged with said inclined surfaces such that said sled is slidable from said lower portion of said inclined surfaces to said upper portion of said inclined surfaces and from said upper portion of said inclined surfaces to said lower portion of said inclined surfaces:

plank means engagable with said base unit for retaining said sled in a wiping position wherein said sled is located in an intermediate position between said upper and lower portions of said inclined surfaces; and means for releasing said sled from said wiping position so that said sled slides to said lower portion of said inclined surfaces.

10. The method of claim 5, wherein the step of maintaining said sled in said wiping position comprises the step of engaging one end of a sled-coupled plank with said base unit.

11. The method of claim 10, wherein said step of positioning said sled into a deactivated position comprises the step of releasing said one end of said sled-coupled plank from said base unit with said button.

12. The method of claim 6, wherein said step of engaging said second of said print carriage with a button on said sled comprises the step of engaging said second end of said carriage with an angled top surface of said button so as to produce a force on said button having both a horizontal component and a vertical component.

13. A method of performing a service to an inkjet printer carriage utilizing an improved service station comprising a base unit, a sled moveable within said base unit into a plurality of operational positions, said print carriage including a plurality of inkjet cartridges an said print carriage being engageable with said sled for moving said sled into said plurality of operational positions, wherein said inkjet printer carriage is moveable across a platen for printing, said method comprising the steps of:

moving said print carriage across said platen in forward direction until said print carriage comes into contact with one end of said sled;

positioning said sled into a first wiping position by sliding said sled along at least one inclined surface, wherein said sled is positioned such that a plurality of wiper blades are aligned for contact with a plurality of inkjet cartridges by lateral movement of said print carriage against one end of said sled in said forward direction;

maintaining said sled in said wiping position by engaging one end of a sled-coupled plank with said base unit as said printer carriage is moved in a backward direction across a wiping path and each of said inkjet cartridges are wiped with a respective wiper blade;

moving said print carriage in a backward direction beyond the wiping path until a second end of said print carriage comes into contact with a button on said sled; and positioning said sled into a deactivated position, due to print carriage force against said button.

14. The method of claim 13, wherein said step of positioning said sled into a deactivated position comprises the step of releasing said one end of said sled-coupled plank from said base unit with said button.

* * * * *